US007596927B2

(12) United States Patent
Moser

(10) Patent No.: US 7,596,927 B2
(45) Date of Patent: Oct. 6, 2009

(54) METHOD OF TAMPER PROOFING A CONTAINER ASSEMBLY WITH AN EASILY OPENED TAMPER EVIDENT SHRINK BAND

(76) Inventor: Jerry W. Moser, P.O. Box 202183, Arlington, TX (US) 76006

( * ) Notice: Subject to any disclaimer, the term of this patent is extended or adjusted under 35 U.S.C. 154(b) by 980 days.

(21) Appl. No.: 11/128,007

(22) Filed: May 12, 2005

(65) Prior Publication Data

US 2005/0258131 A1 Nov. 24, 2005

Related U.S. Application Data

(60) Provisional application No. 60/573,259, filed on May 21, 2004.

(51) Int. Cl.

| | |
|---|---|
| ***B65B 53/02*** | (2006.01) |
| ***B65B 61/26*** | (2006.01) |
| ***B65B 61/02*** | (2006.01) |
| ***B65D 41/62*** | (2006.01) |

(52) U.S. Cl. ..... 53/399; 53/411; 53/412; 53/442; 53/131.4; 53/133.8; 53/557; 53/585; 215/246; 215/254

(58) Field of Classification Search ..... 53/411, 53/131.4, 557, 442, 397, 399, 585, 133.1, 53/133.3, 412, 296, 420, 419, 137.2, 133.5–133.8; 206/497, 459.1, 807; 215/246, 251, 253, 215/254; *B65D 41/54, 41/62*

See application file for complete search history.

(56) References Cited

U.S. PATENT DOCUMENTS

| | | | | | |
|---|---|---|---|---|---|
| 2,121,041 | A | * | 6/1938 | Morgan | 215/246 |
| 2,223,017 | A | * | 11/1940 | Abrams et al. | 215/246 |
| 2,261,875 | A | * | 11/1941 | Dunn | 215/246 |
| 3,623,624 | A | * | 11/1971 | Fujio | 215/253 |
| 3,733,002 | A | * | 5/1973 | Fujio | 206/497 |
| 3,746,201 | A | * | 7/1973 | Fujio | 215/246 |
| 3,802,152 | A | * | 4/1974 | Strub | 53/585 |
| 3,888,067 | A | * | 6/1975 | Cross et al. | 53/296 |
| 3,924,771 | A | * | 12/1975 | Cleff | 215/246 |
| 3,984,005 | A | * | 10/1976 | Amberg | 215/246 |
| 4,004,705 | A | * | 1/1977 | Fujio | 215/246 |
| 4,009,793 | A | | 3/1977 | Minesinger et al. | 215/246 |
| 4,111,738 | A | * | 9/1978 | Amberg | 156/458 |
| 4,538,740 | A | * | 9/1985 | Petersen, Jr. | 215/246 |
| 4,566,923 | A | | 1/1986 | Mueller | 156/69 |
| 4,758,456 | A | * | 7/1988 | Muscala | 428/40.6 |
| 4,922,683 | A | * | 5/1990 | Connolly | 53/296 |
| 5,165,215 | A | * | 11/1992 | Menayan | 53/292 |
| 5,217,307 | A | | 6/1993 | McClintock | 383/81 |

(Continued)

FOREIGN PATENT DOCUMENTS

FR 2598389 A1 * 11/1987

(Continued)

*Primary Examiner*—Stephen F Gerrity
(74) *Attorney, Agent, or Firm*—Charles D. Gunter, Jr.

(57) ABSTRACT

A tamper-evident band is provided which includes a pull tab which is more easily located and more easily grasped by a consumer for removing the tamper-evident band from a container. A method is also disclosed for applying a heat-shrinkable band to a container such that the band is correctly conformed to the configuration of the container with the pull tab properly located for ease of identification and ease of removal.

6 Claims, 2 Drawing Sheets

U.S. PATENT DOCUMENTS

| | | | | |
|---|---|---|---|---|
| 5,544,770 | A * | 8/1996 | Travisano | 206/807 |
| 6,322,864 | B1 | 11/2001 | Fresnel | 428/34.9 |
| 6,691,439 | B1 * | 2/2004 | Miyashita et al. | 40/310 |
| 6,770,345 | B2 * | 8/2004 | Sellars | 428/40.1 |
| 2003/0047937 | A1 | 3/2003 | Chaduc et al. | 283/81 |
| 2005/0023173 | A1 * | 2/2005 | Paoletti | 215/246 |
| 2005/0035081 | A1 * | 2/2005 | Fitch | 215/246 |
| 2005/0229542 | A1 * | 10/2005 | Fresnel | 53/397 |

FOREIGN PATENT DOCUMENTS

| | | | |
|---|---|---|---|
| JP | 08133327 | A * | 5/1996 |
| JP | 11115954 | A * | 4/1999 |
| JP | 2001122303 | A * | 5/2001 |
| JP | 2003237741 | A * | 8/2003 |

* cited by examiner

METHOD OF TAMPER PROOFING A CONTAINER ASSEMBLY WITH AN EASILY OPENED TAMPER EVIDENT SHRINK BAND

CROSS REFERENCE TO RELATED APPLICATIONS

The present application claims priority from earlier filed U.S. Provisional patent application Ser. No. 60/573,259, filed May 21,2004 and entitled "Easily Opened Tamper Evident Shrink Band."

BACKGROUND OF THE INVENTION

1. Field of the Invention

The present invention relates generally to a tamper-evident band for attachment to a container in order to indicate if the container has been tampered with after the band has been attached and to a method of applying a heat-shrinkable band to an associated container for making the container tamper proof.

2. Description of the Prior Art

Tamper-evident bands are useful for alerting consumers of products marketed in bottles and containers that the product might have been opened prior to retail sale. These type bands have been placed on prescription and over-the-counter pharmaceutical products such as eye drops, cosmetics, alcoholic beverages, and many other products. Generally, this type of band will show signs of breakage or distortion when the container cap is rotated relative to the container body. This type of breakage or distortion of the band provides a visual indication to a consumer that the product might have been opened or tampered with prior to sale.

There are a variety of tamper-evident and resistant bands shown in the prior art. One type of tamper-evident seal that has been used in the past is a heat-shrinkable member, usually comprising heat-shrinkable thermoplastic material. This type of heat-shrinkable member is usually applied to an associated container in a generally cylindrical form, with heat thereafter applied to the member so that it shrinks and conforms to the associated container. The material from which the member is formed and the manner in which it is applied are selected such that upon attempted opening or opening of the container, the member is visually and permanently deformed to indicate tampering.

While generally cylindrical heat-shrinkable bands are effective in providing a tamper proof container, they can be difficult for the consumer to remove in the ordinary course of opening the container, e.g., to dispense medicine held in the container. As a result, various types of tear away strip arrangements have been used in the past. These have still generally failed to provide an easy opening tamper-evident band.

Also, since the application of the tamper band is typically performed attendant to high speed packaging of products, it is frequently impractical or impossible to sufficiently control and monitor tamper band application to assure the desired interaction of the bands with their associated containers. Additionally, in the case of heat shrink bands, it was often difficult to locate the tear strip once the material had shrunk so that the tear stip or associated pull tab could be grasped by the user.

Thus, it is desirable to provide a tamper proof container having a pull tab which is easily grasped by a consumer in order to remove the tamper-evident band.

It is also desirable to provide a method of applying heat-shrinkable tamper bands or like members to containers so that it is possible to more easily identify and locate the pull tab or strip.

SUMMARY OF THE INVENTION

The tamper-evident band of the invention can be utilized with a wide variety of containers which hold goods of various descriptions. It is especially suitable for attachment to a container and cap assembly. In such an assembly, the cap is removably attached to the container, the container having a bottom, side walls, a mouth, and top edge adjacent to the mouth, the cap having a top, side walls, and bottom edge adjacent to the mouth of the container. The band is formed from a planar sheet of material having at least one tear strip defined by two parallel perforated lines there through which terminate in a die cut. The planar sheet also has a pair of seam regions which allow the sheet to be folded and joined to make a continuous tube of material which can then be cut in desired lengths.

A series of registration marks are provided on the planar sheet of material for aligning a cut tube of material on an assembled container and cap. The registration marks insure that the tear strip overlays the top edge of the container and bottom edge of the cap when in place on the container. The tear strip also extends over the top edge of the cap so that the die cut is positioned on the top of the cap.

The preferred planar sheet of material is a thermoplastic material which can be heat shrunk in a desired position on the container and cap assembly to thereby form a band of material. The heat shrinkage of the sheet of material, as well as the proper registration of the material on the container by means of the registration marks, causes the die cut to separate and form a tab which protrudes from the planar surface of the sheet of material and which can be grasped by a user in order to more easily separate the band from the container.

Tampering with or removing the band from the assembly by way of pulling on the tear strip, or removing or repositioning the cap from the container, causes the perforated lines of the tear strip to deform or rupture, thereby serving as visible and physical evidence of tampering with the assembly.

In the preferred form of the invention, the tube of material has a central vertical axis with the tear strip being arranged on the sheet of material generally parallel to the central vertical axis. Most preferably, the planar sheet of material has a pair of tear strips defined by two parallel perforated lines there through, each of the tear strips terminating in a die cut. The tear strips are generally equidistantly spaced about the circumference of the continuous tube of material on opposite sides thereof.

In the preferred method of practicing the invention, a planar sheet of thermoplastic material is provided as previously described having at least one tear strip defined by two parallel perforated lines there through which terminate in a series of evenly spaced die cuts, the planar sheet also having a pair of seam regions. The planar sheet is folded at the seam regions with the seam regions being joined to make a continuous tube of material which can then be cut in desired lengths. A series of registration marks are provided on the planar sheet of material for aligning a cut tube of material on an assembled container and cap, whereby the tear strip overlays the top edge of the container and bottom edge of the cap when in place on the container, the tear strip also extending over the top edge of the cap so that the die cut is positioned on the top of the cap. The tube of material is then heat shrunk in a desired position on the container and cap assembly to thereby form a band of material. The step of heat shrinking, as well as the proper registration of the material on the container by means of the registration marks, causes a selected die cut to separate and form a tab which protrudes from the planar surface of the sheet of material and which can be grasped by a user in order to more easily separate the band from the container.

The application of the registration marks is preferably accomplished by the operation of a printing machine. Similarly, the die cuts are preferably made by the operation of a cutting machine, the printing and cutting operations being synchronized in order to properly determine the cut length of the bands. In a preferred embodiment of the invention, the printing machine includes a printing cylinder and the die cutting machine includes a cutting cylinder. The printing cylinder and cutting cylinder are chained together or otherwise linked in order to synchronize the operations and properly determine the cut lengths of the bands.

Additional objects, features and advantages will be apparent in the written description which follows.

DETAILED DESCRIPTION OF THE INVENTION

The present invention is directed to a novel, tamper-evident band for use in various packaging applications. That is, if the container and cap assembly to which the band is adhered is opened or has been tampered with, the label will show signs of wrinkling, distortion or breakage along the tear strips present on the band. The nature of the improved tamper-evident band of the invention may be better understood by reviewing the attached figures in view of the following written description.

Figure 1:
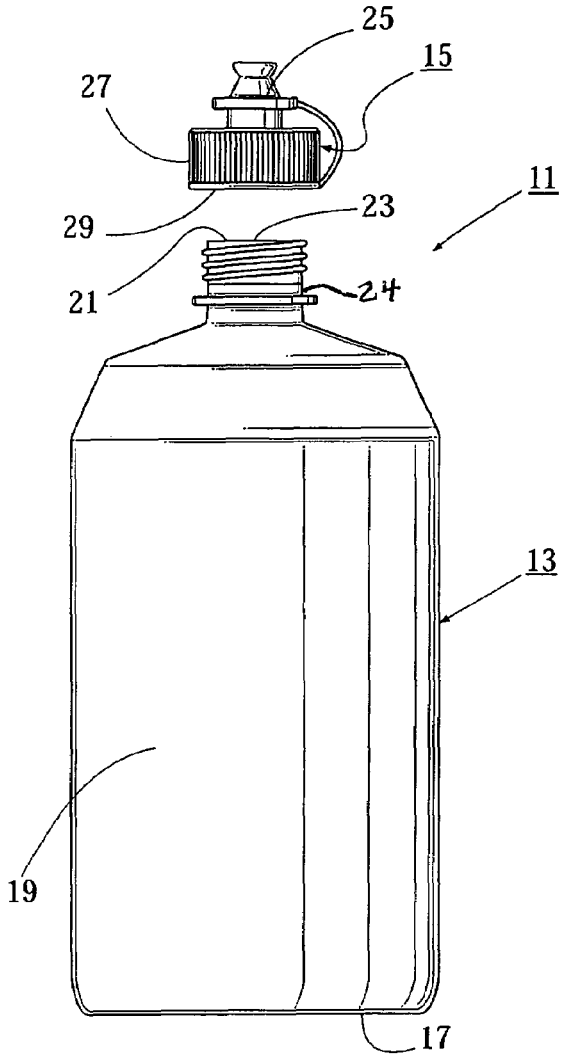
FIG. 1 is a perspective view of a container assembly of the type used in the practice of the invention showing the cap thereof in exploded fashion prior to assembly.

Turning first to FIG. 1, there is shown a perspective view of a container and cap assembly of the type commonly used for marketing pharmaceutical and over-the-counter products prior to having the tamper-evident band of the present invention attached thereto. For example, the container assembly might comprise an eye drop container and associated cap for dispensing eye drop medication. Container and cap assembly 11 is typically fabricated from a thermoplastic material, although glass, metal, or a combination thereof might be employed, as well. The container body portion 13, typically exhibits a rectangular, polygon, elliptical or oval shape. Cap 15, typically, exhibits an identical or complimentary shape to the top of the container, and will be have a twist- or screw-off design. The container 13 has a bottom 17, generally cylindrical side walls 19, a mouth 21, a top edge 23 and a throat region 24 adjacent to the mouth. The cap of the assembly has a top 25, side walls 27, and bottom edge 29 which encloses the mouth 21 and is located adjacent the throat region 24 of the container when the cap is in place on the container.

Figure 2:
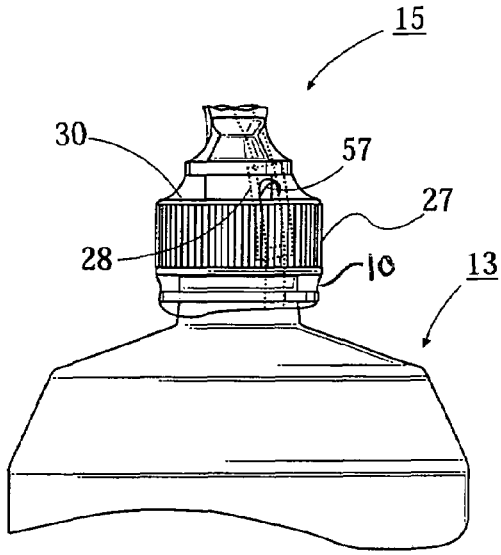
FIG. 2 is an isolated view of the cap and container top showing the placement of the tamper-evident band on the assembly.

As shown in FIG. 2, the container body and cap have applied thereto a tamper-evident band 10. The band 10 is preferably formed from a heat-shrinkable thermoplastic material, such as expanded polystyrene, polypropylene, polyethylene, or polyvinyl chloride. The container shown in the Figures is intended to be illustrative of a typical container construction, since it will be appreciated that the present invention can be readily practiced for applying heat-shrinkable bands to containers of almost an endless variety of configurations. After the band has been positioned on the container, it is shrunk by the application of heat, which is typically accomplished by passing the container through a heat tunnel or like heat source so that the heat-shrinkable bands are substantially entirely heated and shrunk into conformance with the shape of the containers. The attempted opening or opening of the container 11 by removal of its cap aor lid portion 15 requires permanent visible deformation of the heat-shrinkable member for tamper-indicating. However, the invention can also be employed for application of other than a tamper-indicating means, such as protective sleeves that are sometimes fitted to containers.

Figure 3:
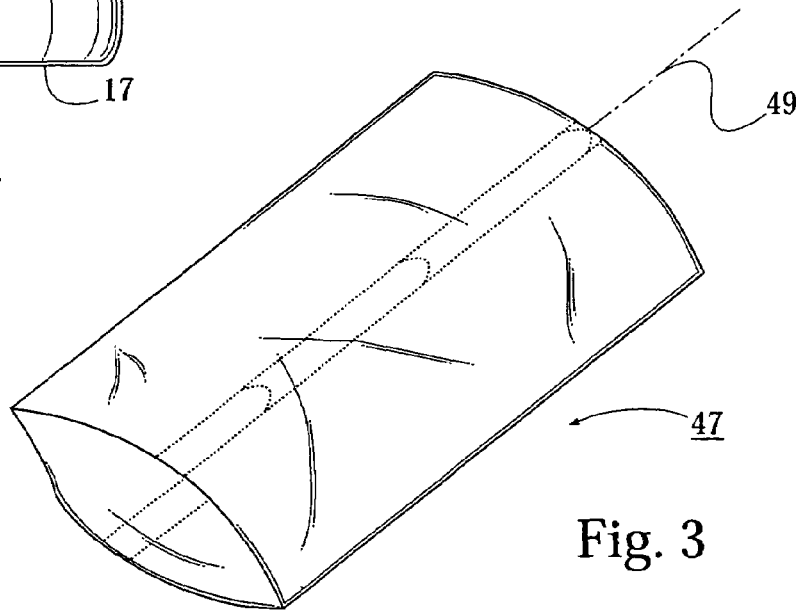
FIG. 3 is an isolated view of a tube of thermoplastic material prior to being placed on the container assembly and heat shrunk into position.
Figure 4:
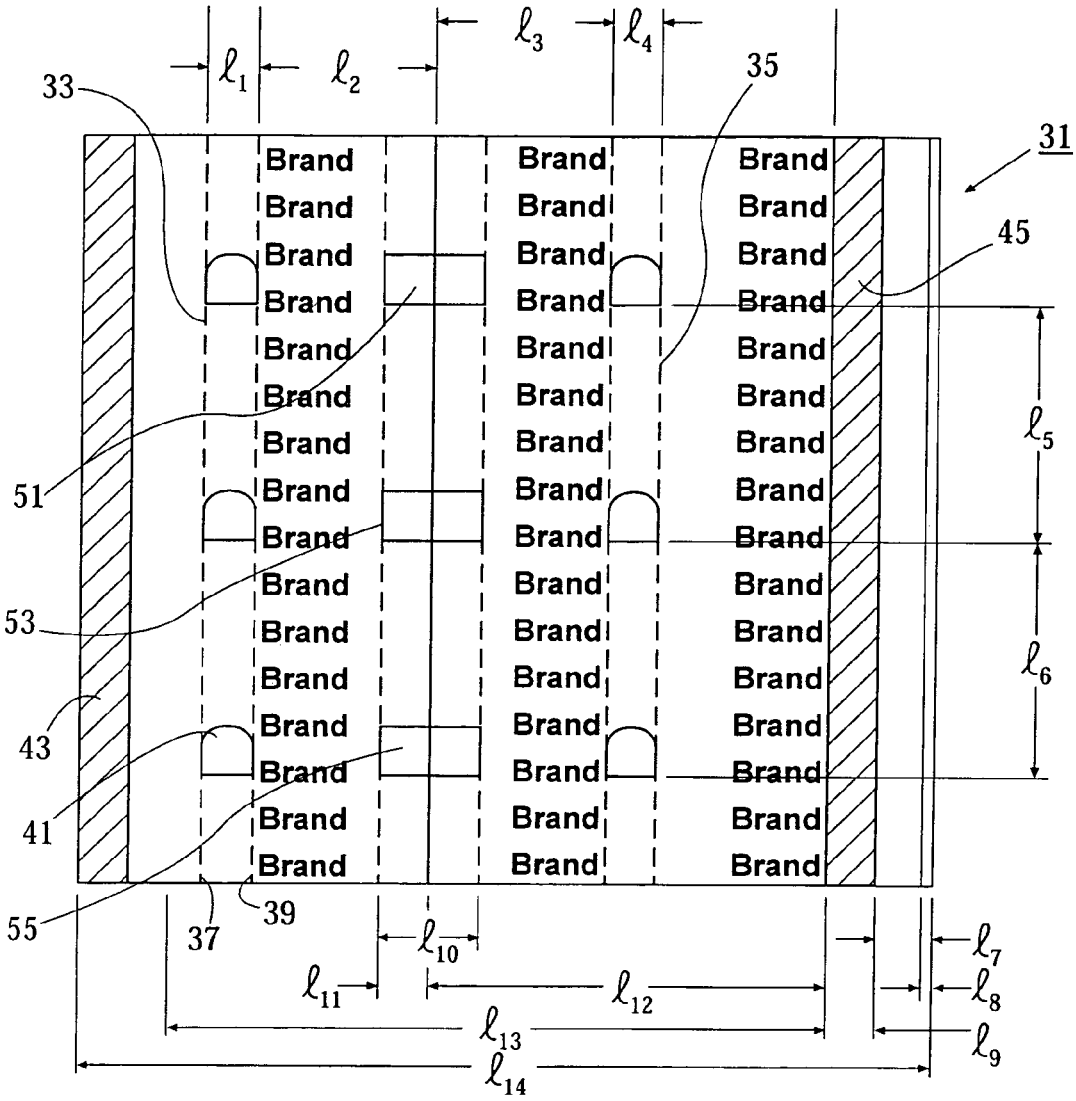
FIG. 4 is a plan view of the sheet of thermoplastic material used to make the tube of FIG. 2 showing the lines of perforations, die cuts and registration marks used in the manufacture of the tamper-evident band of the invention.

As perhaps best understood with reference to FIG. 4, the finished band 10 is made from a beginning stock of thermoplastic sheet material 31. The sheet material is preferably a heat shrinkable thermoplastic such as a commercially available polyolefin. The planar sheet of material 31 has at least one, and preferably two, tear strips 33, 35 defined by two parallel perforated lines (i.e., lines 37, 39, in FIG. 4) therethrough which terminate in a plurality of evenly spaced die cuts 41. There are actually three die cuts in each column of perforations in the particular embodiment of the invention illustrated in FIG. 4. The planar sheet 31 also has a pair of seam regions 43, 45 whereby the sheet can be folded and joined to make a continuous tube of material which can then be cut in desired lengths. The tear strips and seam regions are generally parallel to the central vertical axis (49 in FIG. 3) of the tube of material and are generally equidistantly spaced about the circumference of the tube. FIG. 3 shows a portion of a continuous tube of material 47 which will be cut at three locations to provide three bands of the invention. While the member 47 is generally cylindrical as illustrated, it will be understood that it can assume other configurations as long as it is configured so as to be predominantly heat-shrinkable in a radial direction relative to a central vertical axis 49.

Returning to FIG. 4, there is shown a series of registration marks (i.e., marks 51, 53, 55) on the planar sheet of material for aligning a cut tube of material on an assembled container and cap. The registration marks shown in FIG. 4 are a series of parallel lines arranged generally perpendicular to the central vertical axis (49 in FIG. 3) of the container. It is important for purposes of the invention that the tear strip overlay the top edge (21 in FIG. 1) and neck region 24 of the container 13 and bottom edge 29 of the cap 15 when the cap is in place on the container. As perhaps best seen with respect to FIG. 2, the tear strip 28 also preferably extends over the top edge 30 of the cap so that the die cut is positioned at least partly on the top of the cap. Note the die cut 57 in FIG. 2 of the drawings. With the band in this position tampering with or removing the band from the assembly by way of pulling on the tear strip, or removing or repositioning the cap from the container, causes the perforated lines of the tear strip to deform or rupture, thereby serving as visible and physical evidence of tampering with the assembly.

Table I below shows the typical dimensions for location of the tear strips, die cuts, seam regions and registration marks to allow the band to be properly printed, cut and positioned on the container assembly illustrated in the drawings. These dimensions are intended to be exemplary of one embodiment of the invention, it being understood that the dimensions can be varied, depending in part upon the shape of the container and cap.

TABLE I

| Reference Character | Dimension in mm |
|---|---|
| $l_1$ | 7 |
| $l_2$ | 25 |
| $l_3$ | 25 |
| $l_4$ | 7 |
| $l_5$ | 35 |
| $l_6$ | 35 |
| $l_7$ | 7 |
| $l_8$ | 1 |
| $l_9$ | 7 |
| $l_{10}$ | 14 |
| $l_{11}$ | 7 |
| $l_{12}$ | 57 |
| $l_{13}$ | 94 |
| $l_{14}$ | 122 |

As best seen in FIG. 2, heat shrinking the tube of material (47 in FIG. 3) in a desired position on the container and cap assembly as determined by the registration marks, causes the die cut to separate and form the tab 57 which protrudes from the planar surface of the sheet of material and which can be grasped by a user in order to more easily separate the band from the container. Applicant's tab is already exposed after the heat shrinking step, so that it can be easily located by the user and more easily grasped. That is, the tab 57 protrudes above the plane or contour of the remainder of the exterior surface of the band 10. Preferably, the registration marks (51, 53, 55 in FIG. 4) are applied by the operation of a printing machine and the die cuts are made by the operation of a cutting machine, the printing and cutting operations being synchronized in order to properly determine the cut length of the bands.

Figure 5:
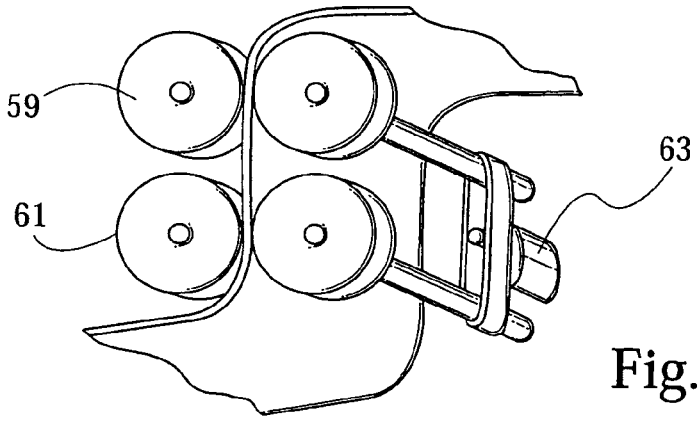
FIG. 5 is a simplified, schematic view of the printing cylinder and die cutting cylinders used in the method of the invention.

FIG. 5 is intended to be a schematic illustration of the printing and cutting steps. Any number of commercially available machines can be utilized to perform these operations and such machines will be well familiar to those skilled in the relevant packaging arts. The printing machine preferably includes a pair of mating printing plate cylinders 59 and the die cutting machine preferably includes a pair of mating die cutting cylinders or wheels 61. The printing and cutting cylinders are preferably chained together in order to synchronize the operations and properly determine the cut lengths of the bands. In FIG. 5, the printing and cutting cylinders are shown physically chained by the loop mechanism 63 in order to illustrate the principle involved in simplified fashion.

As will be evident from FIG. 4, the printing machine can also conveniently include an indicia printing function or station for printing brand indicia, or other useful information, onto the tube of material. For example, the term "Brand" in FIG. 4 could be replaced by a manufacturer's trademarked brand or logo. As shown in FIG. 4, the brand indicia, "Brand", is also synchronously registered with die cuts 41 and registration marks 53, 55, in this case evenly spaced columns.

For example, with reference to FIG. 5, for each revolution of the printing plate cylinder 59, there is one corresponding revolution of the die cutting wheel 61. For a 1½ repeat pattern on the cylinder of material, 4 tabs would be produced per revolution of the printing plate cylinder. It will be understood, however, that the printing and cutting operations could also be synchronized by means of ultrasonic sensors, optic sensors, or other sensing means which would detect the presence of the registration marks 55, 57. A modem packaging line can produce on the order of 300 bands per minute in the fashion described.

An invention has been described with several advantages. The tamper-evident band of the invention produces a tab which protrudes from the planar surface of the sheet of heat shrunk thermoplastic material, making the tab easy to locate and easy to pull. In this way, a user can more easily identify the pull tab and more easily remove the band to access the contents of the container. The tab is pulled in a longitudinal direction generally aligned with or parallel to the longitudinal axis of the container being sealed. The tamper-evident band, when in place, assures the consumer that the package has not been violated, since tampering with or removing the band from the assembly by way of pulling on the tear strip, or removing or repositioning the cap from the container, causes the perforated lines of the tear strip to deform or rupture, thereby serving as visible and physical evidence of tampering with the assembly. The tamper band of the invention is simple in design and economical to manufacture and is well adapted for implementation in an automated packaging line.

I claim:

1. A method for tamper proofing a container assembly, which assembly includes a container and a cap, the cap being removably attached to the container, the container having a bottom, side walls, a mouth, and a throat region adjacent to the mouth, the cap having a top, side walls, and bottom edge adjacent to the throat region of the container when assembled on the container, the method comprising the steps of:

providing a planar sheet of thermoplastic material having at least one tear strip defined by two parallel perforated lines there-through which terminate in at least one die cut, the planar sheet also having a pair of seam regions;

folding the planar sheet of material at the seam regions and joining the seams to make a continuous tube of material which can then be cut in desired lengths;

providing a series of registration marks on the planar sheet of material for aligning a cut tube of material on an assembled container and cap, whereby the tear strip overlays the throat region of the container and bottom edge of the cap when in place on the container, the tear strip also extending over the top edge of the cap so that the die cut is positioned over the top of the cap;

heat shrinking the tube of material in a desired position on the container and cap assembly to thereby form a band of material, the step of heat shrinking, as well as the proper registration of the material on the container by means of the registration marks, causes the die cut to separate and form a tab which protrudes from the planar surface of the sheet of material and which can be grasped by a user in order to more easily separate the band from the container.

2. The method of claim 1, wherein the tab which protrudes from the planar surface of the sheet of material extends along a vertical longitudinal axis which is aligned with or parallel to a vertical longitudinal axis of the container.

3. The method of claim 1, wherein the planar sheet of material has a pair of tear strips, each of which is defined by two parallel lines there-through, each of the tear strips terminating in at least one die cut, the tear strips being generally equidistantly spaced about the circumference of the band.

4. The method of claim 1, wherein the registration marks are applied by the operation of a printing machine and the die cuts are made by the operation of a cutting machine, the printing and cutting operations being synchronized in order to properly determine the cut length of the bands.

5. The method of claim 4, wherein the printing machine includes a printing cylinder and the die cutting machine includes a cutting cylinder, the printing cylinder and cutting cylinder being chained together in order to synchronize the operations and properly determine the cut lengths of the bands.

6. The method of claim 5, wherein the printing machine also includes an indicia printing function for printing brand indicia onto the band, the brand indicia also being synchronously registered with the die cuts and registration marks.

* * * * *